United States Patent [19]

Barkley

[11] Patent Number: 4,696,230

[45] Date of Patent: Sep. 29, 1987

[54] ADJUSTABLE BUSTLE-FORMING APPARATUS FOR MAINTAINING REGISTRATION OF MULTICOLOR IMAGES ON PRINTING WEBS

[75] Inventor: George J. Barkley, North Barrington, Ill.

[73] Assignee: Barkley Corporation, Elk Grove Village, Ill.

[21] Appl. No.: 911,397

[22] Filed: Sep. 25, 1986

[51] Int. Cl.[4] ..... B41F 13/02

[52] U.S. Cl. ..... 101/181; 101/DIG. 21

[58] Field of Search ..... 101/219, 248, 220, 221, 101/222–228, 178–182, 138, 139, DIG. 21; 226/2, 7, 97; 34/10, 57 A, 57 D, 155, 156, 160

[56] References Cited

U.S. PATENT DOCUMENTS

| | | | |
|---|---|---|---|
| 3,013,487 | 12/1961 | Faeber | 101/181 |
| 3,265,272 | 8/1966 | Smith | 226/196 |
| 3,521,802 | 7/1970 | Bossons | 226/97 |
| 3,622,058 | 11/1971 | Vits | 226/7 |
| 4,182,472 | 1/1980 | Peekna | 226/97 |
| 4,197,972 | 4/1980 | Daane | 226/97 |
| 4,200,211 | 4/1980 | Yamagishi et al. | 226/21 |
| 4,335,857 | 6/1982 | Pfost et al. | 242/192 |
| 4,404,906 | 9/1983 | Curran | 101/211 |
| 4,472,888 | 9/1984 | Spiller | 226/97 |

*Primary Examiner*—J. Reed Fisher

*Attorney, Agent, or Firm*—Burmeister, York, Palmatier, Hamby & Jones

[57] ABSTRACT

One or more wheel-air bustling devices are adjustably mounted between successive printing units of a multicolor printing press, to form adjustable bustles or ridges in the printed paper web. The bustles effectively shrink the width of the web, back to its original width, so that the previously printed color image is brought into precise registration with the next printed color image. Each bustling device comprises a body adjustably clamped to a supporting rod, a hollow tubular externally threaded stem movable through a guide opening in the body, an internally threaded adjusting knob received around the stem and rotatably retained on the body for longitudinally adjusting the stem, an air nozzle mounted on the upper end of the stem for directing an air jet against the web to form a longitudinal bustle or ridge therein, and a bustle wheel mounted on a bustle frame which is adjustable along the stem to raise and lower the wheel between operative and inoperative positions. When the wheel is raised to its operative position, the wheel is engageable with the web to form a bustle therein. The stem is movable to adjust the depth of the bustle, for both wheel bustling and air bustling. Each bustling device has its own ON-OFF air valve and its own flow regulating valve for adjusting the force of the air jet.

21 Claims, 13 Drawing Figures

ADJUSTABLE BUSTLE-FORMING APPARATUS FOR MAINTAINING REGISTRATION OF MULTICOLOR IMAGES ON PRINTING WEBS

FIELD OF THE INVENTION

This invention relates to multcolor printing presses having successive printing units for printing images or impressions of different colors on a printing web, usually made of paper. In many cases, a printing press of this type has four printing units for use in four-color printing. In order to produce high quality multicolor printing, it is necessary to register the successively printed images with one another, with a high degree of precision, approaching absolute perfection. Multicolor printing presses often employ the offset printing process, in which inked images are transferred from a printing plate to a rubber covered offset cylinder, and then to the paper printing web.

BACKGROUND OF THE INVENTION

In the web offset printing press business, there is a common problem in printing successive images of different colors in perfect register from unit to unit. This problem is due to the unstable character of the printing paper, which tends to increase in width or fan out, as it passes through the successive printing press units.

Thus, the paper web passes through the first printing unit and is printed with a first color image. The passage of the paper web through the first printing unit causes the web to fan out, or be increased a small amount in width, so that the width of the first printed image is also increased. When the web passes through the second printing unit, the first printed image is no longer in perfect register with the second printed image, produced by the second printing unit. This fanning out or increased width of the printing web tends to occur as the web passes through each of the printing units, and then travels to the next printing unit. This problem of web fanout, or increased web width, due to the printing action of the printing press units, makes it impossible to achieve perfect crosswise or lateral registration between the successively printed color images in a multicolor printing press.

In the past, somewhat primative attempts have been made to deal with this problem of web fanout. One approach has been to install a wheel between each pair of printing units. The wheel is brought into contact with the web, to apply a variable amount of pressure between the wheel and the web, so as to form a longitudinal bustle or ridge in the web. The bustling pressure may be applied at various points on the web, including the center of the web and other points across the web. The bustling of the printed web will actually pull the web back to its original width, so that the first printed color image is drawn back into register with the next printed color image.

The bustling wheel has generally been made of steel or nylon and has been mounted on a threaded rod, so that the wheel can be screw adjusted, up or down, to apply pressure on the printed web. The use of the bustle wheel has the disadvantage that it can smear the ink or produce tracking marks on the printed web, unless the wheel can be brought into engagement with a clear unprinted longitudinal area on the printed web.

To avoid the ink smearing problem caused by bustle wheels, there has been another somewhat primative approach, to use a piece of copper tubing or pipe, with or without some type of nozzle, to blow compressed air up against the web, between successive printing units, to force the bustling action without actually touching the printed paper web.

SUMMARY OF THE INVENTION

One object of the present invention is to provide a new and improved combination wheel-air bustling device, having both a bustling wheel and a bustling air nozzle which may be selectively employed to produce a bustle in a printing web, between successive printing units of a printing press, for effectively shrinking the width of the web to its original width, and thereby establishing and maintaining precise registration between the successive images printed by the printing units on the web.

A further object is to provide such a new and improved combination wheel-air bustling device, having means for selecting between the use of the bustling wheel and the air nozzle; means for adjusting the lateral position of the device across the width of the printing web, to adjust the location of the bustle; means for precisely adjusting the position of the bustling air nozzle or wheel, whichever is selected, in a direction perpendicular to the printing web, to adjust the depth of the bustle; and means for precisely adjusting the supply of compressed air to the air nozzle, for additionally controlling the depth of the bustle.

A further object is to provide a new and improved bustling apparatus, incorporating a plurality of such wheel-air bustling devices into a complete system, in which one or more such bustling devices are adjustably positioned between each pair of successive printing units, with provision for individually adjusting the positions of the bustling devices, and provision for controlling the supply of compressed air to each of the air nozzles, as well as provision for controlling the supply of compressed air to all of the air nozzles collectively.

In this way, one or more bustles of precisely adjustable location and depth may be formed in the printing web between each successive pair of printing units, by using either bustle wheels or bustle air nozzles, or any combination thereof, for effectively shrinking the width of the web to its original width, whereby all of the successively printed color images can be precisely registered with one another.

In accordance with the present invention, these and other objects of the invention are achieved by providing a combination wheel-air bustling device for producing an adjustable bustle in a printing web as it travels between successive printing units of a multicolor printing press, such device comprising supporting means having mounting means for mounting such supporting means in a selected location between the successive printing units and opposite the printing web, carriage means movably mounted on such supporting means for movement in a direction generally perpendicular to the printing web, air nozzle means mounted on such carriage means to direct an air jet against the web for producing a bustle therein, bustle wheel means mounted on such carriage means to engage and deflect the web for producing a bustle therein, selecting means to produce relative movement between the bustle wheel means and the air nozzle means for selectively bringing either the air nozzle means or the bustle wheel means into its operative bustle-forming relationship with the printing web to form a bustle therein, and adjusting means for producing adjusting movement of the carriage means and the selected air nozzle means or bustle wheel means in a direction generally perpendicular to the printing web for adjusting the depth of the bustle formed therein by the selected air nozzle means or bustle wheel means.

The supporting means may include a supporting body having a guide opening therein. The carriage means may include a hollow tubular stem movably received in such guide opening for movement in a direction generally perpendicular to the printing web. Such stem preferably has a longitudinal air supply opening extending therein. The air nozzle means may include an air nozzle connected to one end of such air supply opening for movement with such stem, toward and away from the web. The stem may have means connected to the other end of the air supply opening for supplying compressed air thereto. Such adjusting means may comprise an adjusting mechanism connected between the body and the stem for producing adjusting movement of the stem through the guide opening.

The adjusting mechanism preferably comprises a rotatable adjusting knob rotatably retained on the supporting body and having a bore aligned with such guide opening and formed with internal screw threads. The stem preferably extends through such bore. and has external screw threads mating with such internal screw threads, whereby rotation of such knob causes adjusting movement of the stem through the guide opening.

The supporting body preferably includes a pair of fork portions with a slot therebetween for rotatably receiving and retaining the adjusting knob. A retaining device may be provided to retain the adjustment of the stem relative to the body.

The bustle wheel means may comprise a bustle wheel frame mounted on the stem, and a bustle wheel rotatably mounted on such frame. The selecting means may comprise a portion of such bustle wheel frame, formed with a stem opening in which such stem is movably received to provide for adjusting movement of such frame along the stem relative to the air nozzle, whereby the bustle wheel is movable into and out of operative engagement with the printing web. The wheel frame may have a clamping screw or some other retaining means for retaining the adjustment of the frame along the stem.

The mounting means may comprise a transverse supporting bore, extending generally parallel with the web and transversely to the direction of the stem. The supporting body may have a transverse opening for movably receiving such transverse supporting bar. A clamping screw or other clamping means may be provided for selectively clamping the body to the transverse supporting bar.

The air nozzle is adapted to be connected to a compressed air supply system, preferably including a fully adjustable air regulating valve for adjusting the pressure of the compressed air supplied to the air nozzle, and thereby adjusting the strength of the air jet and the depth of the air bustle in the printing web. An ON-OFF air valve is preferably connected in series with the regulating valve for turning on and shutting off the supply of compressed air to the nozzle.

The present invention also preferably provides an apparatus comprising a plurality of such wheel-air bustling devices, mounted in a laterally spaced arrangement, adapted to be positioned between the printing units and opposite transversely spaced portions of the printing web to form a plurality of transversely spaced bustles therein. The bustling devices may be arranged in a plurality of groups, adapted to be mounted between successive printing units of a multicolor printing press. The bustling devices are preferably provided with individual fully adjustable air regulating valves for individually adjusting the pressure of the compressed air supplied to the individual air nozzles. Thus, the depth of each air bustle can be adjusted individually. The air nozzles are also preferably provided with individual ON-OFF air valves. The compressed air supply system may also be provided with master ON-OFF air valves for shutting off the various groups of the air nozzles, and for shutting off all of the air nozzles.

The ON-OFF air valves are preferably solenoid operated, to provide for convenient electrical remote control, by a bank of electrical switches, mounted on a control panel.

If only air bustling is desired, the bustle frames and wheels can be removed from the adjustable stems of the bustling devices.

BRIEF DESCRIPTION OF THE DRAWINGS

Further objects, advantages and features of the present invention will appear from the following detailed description, taken with the accompanying drawings, in which.

DETAILED DESCRIPTION OF ILLUSTRATIVE EMBODIMENTS

Figure 1:
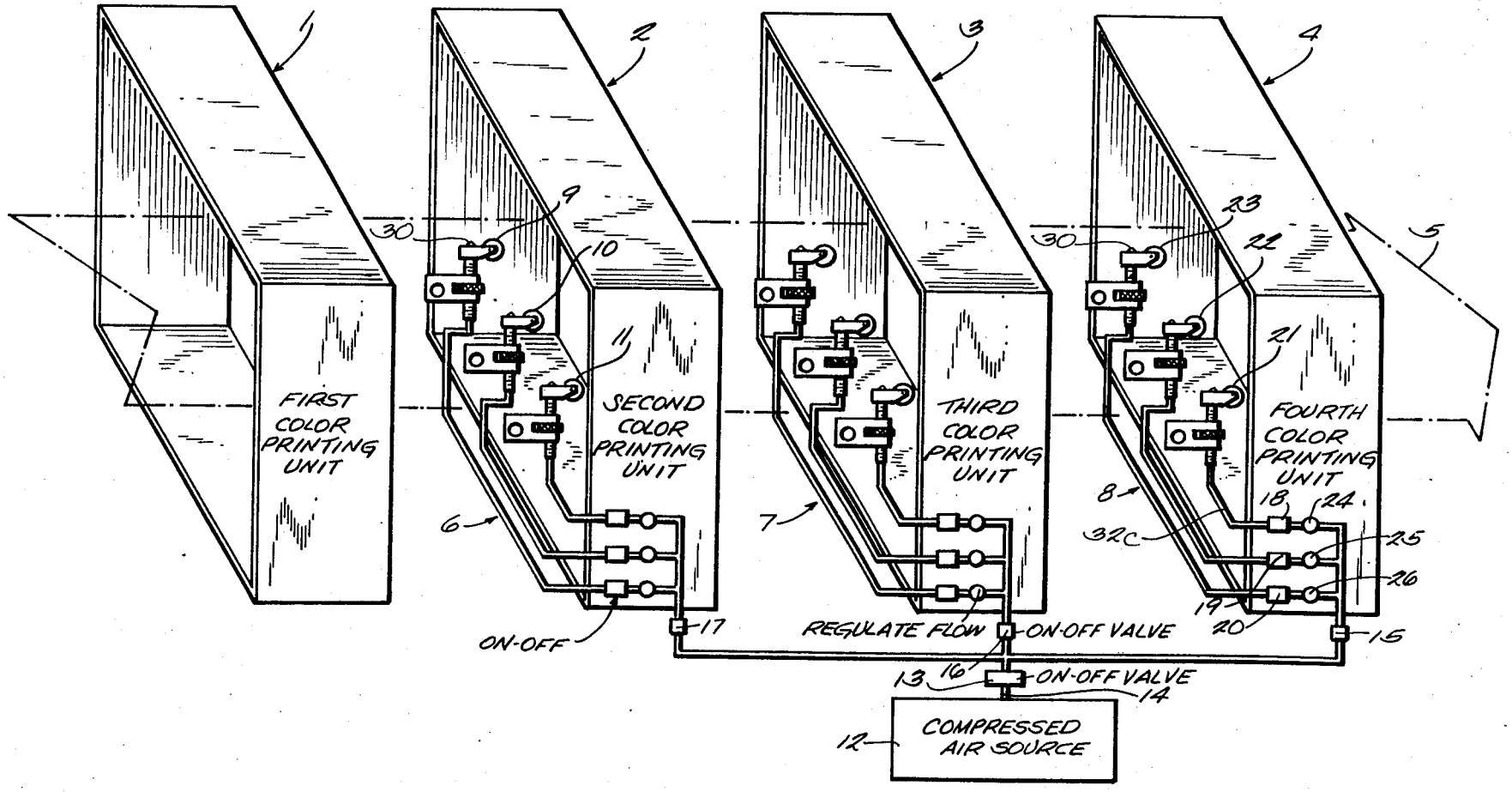
FIG. 1 is a somewhat diagrammatic perspective view, illustrating a multicolor printing press equipped with a bustling apparatus incorporating a multiplicity of wheel-air bustling devices to be described as illustrative embodiments of the present invention, such bustling devices being mounted between the successive printing units of the printing press for bustling the printed web.
Figure 2:
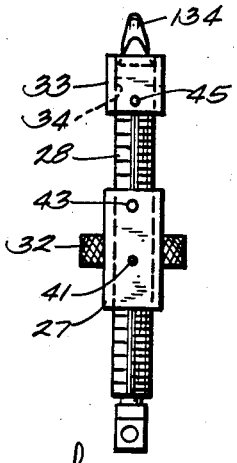
FIG. 2 is an end elevational view, illustrating one of the wheel-air bustling devices, with the bustling wheel adjusted to the wheel-bustling position, in which the wheel protrudes beyond the air nozzle for bustling the printed web.
Figure 3:
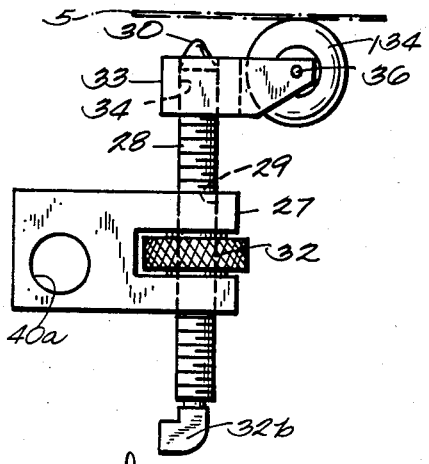
FIG. 3 is a side elevation of the bustling device, as shown in FIG. 2.
Figure 4:
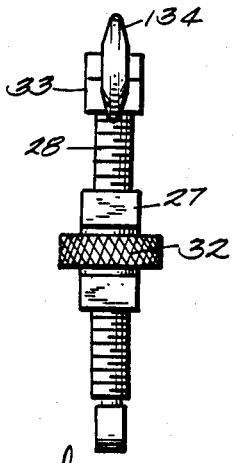
FIG. 4 is an end view showing the opposite end of the bustling device of FIGS. 2 and 3.
Figure 5:
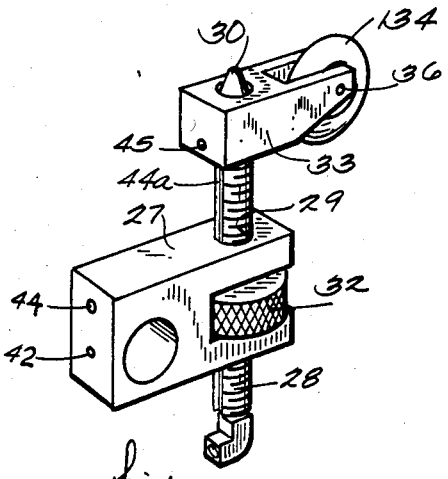
FIG. 5 is a perspective view illustrating the bustling device, as shown in FIGS. 2–4.
Figure 6:
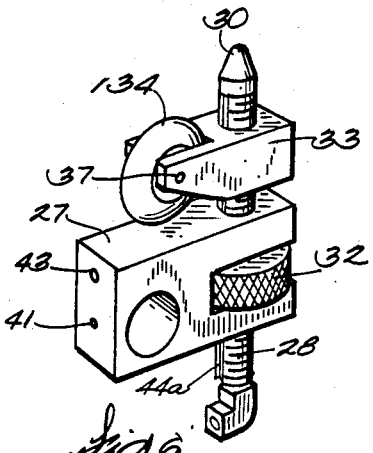
FIG. 6 is a perspective view, similar to FIG. 5, but showing the bustling device with the bustling wheel withdrawn relative to the air nozzle, so that the bustling wheel is inactivated, while the air nozzle is in a position to form a bustle in the printing web.
Figure 7:
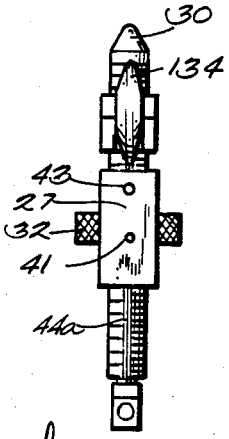
FIG. 7 is an end elevation showing the bustling device adjusted for air bustling, as in FIG. 6.
Figure 8:
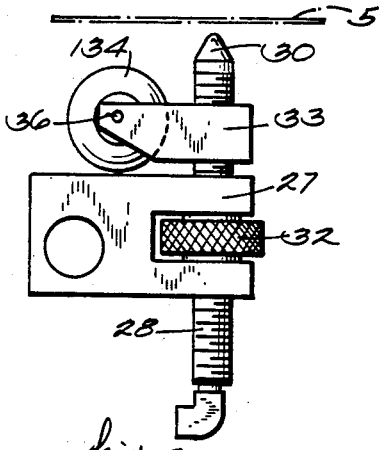
FIG. 8 is a side elevation of the bustling device with the bustle wheel retracted and with the air nozzle brought into a closely spaced relation with the printed web to form a bustle therein.
Figure 9:
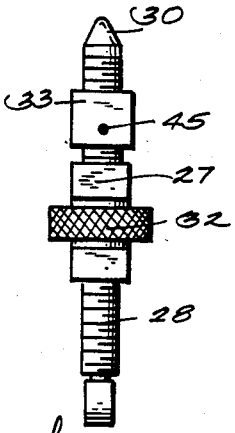
FIG. 9 is an opposite end elevation showing the bustling device as illustrated in FIGS. 6–8.

FIG. 1 shows a bustling apparatus, constituting an illustrative embodiment of the present invention, as applied to a multicolor printing press, which includes first, second, third and fourth printing units 1, 2, 3 and 4, adapted to print four superimposed images or impressions of different colors on a paper printing web 5, as it is fed through the successive printing units. The printing action of the first printing unit 1 tends to cause the printed web 5 to fan out to a slightly increased width, as the web passes through and emerges from the first printing unit. This fanout presents a problem, in that the first printed image also is increased slightly in width, so that the first image does not register perfectly with the second printed image, produced by the second printing unit. Such fanning out of the web 5 also tends to occur as the web passes through and emerges from the second and third printing units 2 and 3. Thus, each of the first three printed images tends to be widened slightly, so that it does not register perfectly with the next printed image.

To overcome the problem of web fanout, the present invention causes the web to shrink back to its original width, by providing bustling means between the successive printing units, to form longitudinal bustles or ridges in the printed web, whereby the web is restored to its original width.

In FIG. 1, the complete bustling means or apparatus takes the form of three bustling systems or groups 6, 7 and 8, disposed in the three spaces between the four printing units 1–4. Each of the bustling systems 6, 7 and 8 comprises one or more bustling devices, adapted to form transversely spaced bustles in the printed web 5. In FIG. 1, each of the bustling systems 6, 7 and 8 comprises three such bustling units 9, 10 and 11, all of which may be substantially the same in construction. Each of the bustling devices 9–11 is adapted to provide either wheel bustling or air bustling, as selected by the operator. The apparatus of FIG. 1 includes a COMPRESSED AIR SOURCE 12, to supply pressurized air to all of the bustling devices 9–11. A master ON-OFF valve 13, preferably solenoid operated, is connected into the air line 14, extending from the compressed air source 12, for turning on and shutting off the supply of compressed air to all of the bustling devices 9–11 in all of the bustling systems 6–8. The air line system has three branches including ON-OFF valves 15, 16 and 17, which are preferably solenoid operated. The valve 15 controls the supply of compressed air to the bustling system 8; the valve 16 to the bustling system 7; and the valve 17, to the bustling system 6.

Each of the three bustling systems 6, 7 and 8 includes three ON-OFF valves 18, 19 and 20, preferably solenoid operated, for controlling the supply of compressed air to the individual bustling devices. In the third bustling system 8, the bustling devices, identified as 21, 22 and 23, are supplied with compressed air by the ON-OFF valves 18, 19 and 20, respectively. In addition, fully adjustable air flow regulating valves 24, 25 and 26 are connected in series with the ON-OFF valves 18, 19 and 20, to regulate the pressure of the compressed air supplied to the bustling devices 21, 22 and 23, respectively.

It should be understood that all of the bustling devices 9, 10, 11, 21, 22 and 23 are essentially the same, and that each of the bustling devices is provided with its own ON-OFF valve, as represented by the solenoid valves 18, 19 and 20, and its own flow regulating valve, as represented by the valves 24, 25 and 26. This is true of all of the bustling devices in all of the bustling systems 6, 7 and 8.

Figure 10:
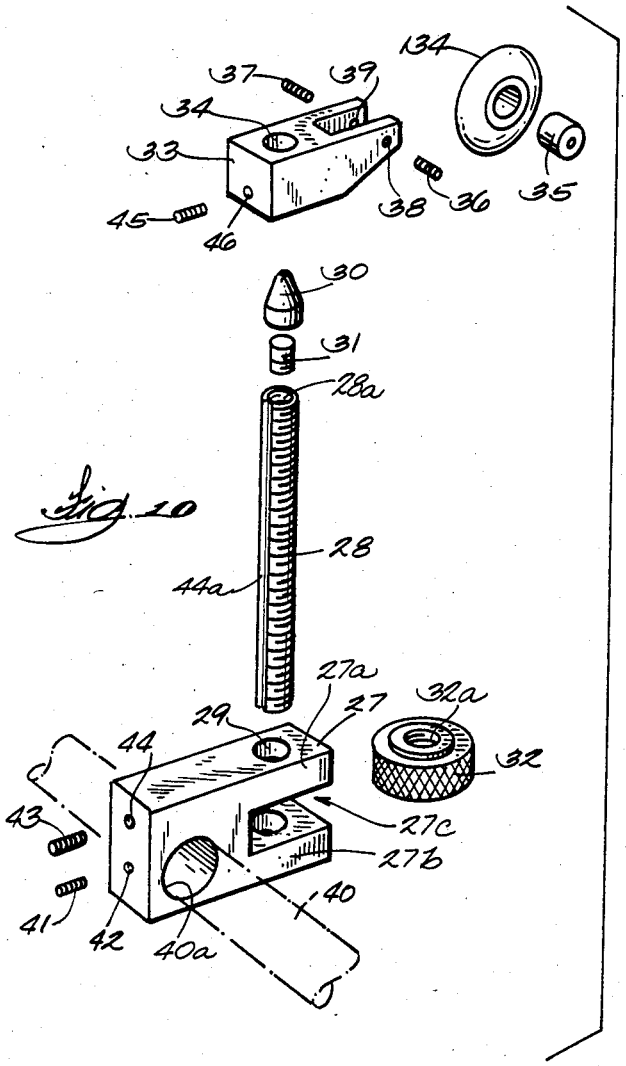
FIG. 10 is an exploded or disassembled perspective view of the bustling device of FIGS. 1–9, having an air nozzle and a bustling wheel for selectively producing a bustle in the printed web.

FIGS. 2–9 show details of an assembled bustling device, corresponding with the bustling devices 9–11 and 21–23 of FIG. 1. The construction of all of the bustling devices may be the same as represented in FIGS. 2–9. FIG. 10 is an exploded perspective view of the same bustling device, except for a slight modification which will be described presently.

The bustling device of FIGS. 2–10 includes a supporting body 27, adapted to be adjustably mounted, as will be described presently. The body 27 provides support for a movable carriage in the form of a hollow tubular externally threaded stem 28, movably received in a guide opening 29, extending through the body 27 in a direction generally perpendicular to the printed web 5. A longitudinal air supply opening 28*a* extends within the hollow stem 28, to supply compressed air to an air nozzle 30, connected to one end of the stem 28, shown as the upper end in FIGS. 2–10. The connection is afforded by a threaded nipple 31, threadedly received in the lower portion of the nozzle 30 and in the upper portion of the air supply opening 28*a*. The stem 28 carries the nozzle 30 for adjusting movement, toward and away from the printed web 5. The nozzle 30 is adapted to direct a jet of air against the web 5, so as to produce a bustle therein, having a depth depending upon the adjusted position of the nozzle 30 and the adjusted strength of the air jet.

To adjust the position of the carriage or stem 28, the bustle device is provided with a rotatable adjusting knob 32 having an internally threaded opening or bore 32*a* therein. The externally threaded stem 28 is threadedly received in the internally threaded bore 32*a*, while being slidably received in the guide bore 29, formed in the supporting body 27. As shown to best advantage in FIG. 10, the body 27 has upper and lower fork portions 27*a* and 27*b*, with a slot 27*c* therebetween. The knob 32 is rotatably retained in the slot 27*c*. The internally threaded bore 32*a* is aligned with the guide opening 29, so that the externally threaded stem 28 can be slid through the guide opening 29, while being screwed through the internally threaded bore 32*a*. The guide opening 29 has portions extending through both fork portions 27*a* and 27*b* of the body 27. The stem 28 is slidable through both portions of the bore 29. The threaded stem 28 is raised and lowered by rotating the adjusting knob 32 in opposite directions.

Compressed air is supplied to the lower end of the air supply opening 28*a* by suitable means, including an angle fitting 32*b*, threadedly received in the lower end of the opening 28*a* , as shown in FIGS. 2–9. The fitting 32*b* provides a connection for an air supply hose 32*c*, as shown in FIG. 1.

The bustling device of FIGS. 2–10 comprises a wheel frame 33 formed with an opening 34 for receiving the stem 28. As shown in FIGS. 2–10, the wheel frame 33 is adjustably mounted on the upper portion of the stem 28, which projects toward the printed web 5. The wheel frame 33 is bifurcated to receive a bustle wheel 134, rotatably mounted on a bearing 35 which is supported by a pair of externally threaded axles 36 and 37. The frame 33 is provided with a pair of threaded openings 38 and 39 for threadedly receiving the axles 36 and 37, whereby the bearing 35 and the wheel 134 can easily be installed and removed from the frame 33.

The wheel frame 33 is adapted to be clamped in its adjusted position on the stem 28 by a set screw 45, threadedly received in an opening 46, which extends into the wheel frame 33 and intersects with the stem opening 34, so that the set screw 45 can be moved into and out of clamping engagement with the stem 28.

The supporting body 27 is provided with adjustable mounting means, whereby the body 27 is adapted to be mounted for adjustment in a direction transverse to the longitudinal direction of the printed web 5. As shown in FIGS. 10 and 12, the body 27 is mounted on a transversely extending support bar or rod 40 which is carried on one of the associated printing units 2–4, each of which has such a support rod 40, on which all three of the associated bustling devices are adjustably mounted. Each support rod 40 is generally parallel with the transverse dimension of the web 5. The body 27 is formed with a transverse opening 40*a* for slidably receiving the support rod 40, whereby the body can be slidably adjusted along the support rod. The body 27 is adapted to be clamped or otherwise retained in its adjusted position, as by a set screw 41, threadedly received in an opening 42 which intersects with the opening 40*a*, so that the set screw 41 can be moved into and out of clamping engagement with the support rod 40.

The supporting body 27 is provided with retaining means for clamping or otherwise retaining the adjustable carriage or stem 28 in its adjusted position on the supporting body 27. As shown in FIG. 10, a retaining device, shown as a set screw 43, is threadedly received in an opening 44 which intersects with the opening 29, so that the set screw 43 can be moved into and out of clamping engagement with the stem 28. As shown to best advantage in FIG. 10, the outside of the stem 28 is formed with a longitudinal groove or channel 44*a*, adapted to receive the tip of the set screw 43. Preferably, the groove 44*a* is V-shaped in cross section, while the tip of the set screw 43 may be correspondingly cone-shaped. When it is desired to adjust the vertical position of the threaded stem 28, the set screw 43 may be loosened slightly, so that the tip of the set screw is out of clamping engagement with the stem 28, while still being loosely received in the groove 44*a*. The internally threaded adjusting knob 32 is then rotated in on direction or the other, to raise or lower the externally threaded stem 28. The slightly loosened set screw 43, still loosely received in the groove 44*a*, prevents rotation of the stem 28. When the stem 28 has been adjusted to its desired vertical height, the set screw 43 is tightened into the groove 44*a*, to clamp the stem 28 to the supporting body 27, so that the adjustment will be maintained.

The groove 44*a* is also adapted to receive the tip of the set screw 45 on the wheel frame 33. The provision of the groove 44*a* makes it possible to tighten the set screws 43 and 45 very tightly against the stem 28, without damaging the external threads on the stem.

Figure 11:
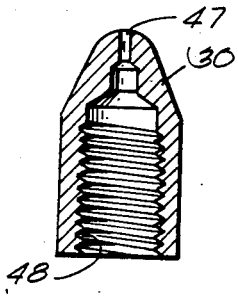
FIG. 11 is a longitudinal section, taken through the air nozzle of FIG. 10.

As shown in the sectional view of FIG. 11, the air nozzle 30 has an air exit orifice 47 through which compressed air is discharged to produce an air jet which is directed against the printed web 5, to form a bustle in the web. The opposite end of the nozzle 30 is provided with an internally threaded opening 48, for threadedly receiving the externally threaded nipple 31, whereby the nozzle 30 is connected to the upper end of the hollow tubular stem 28, as previously described.

FIG. 12 shows the manner in which the bustling devices 9, 10 and 11 form transversely spaced longitudinal bustles or ridges 49, 50 and 51 in the paper web 5. In this case, the operator has selected the bustle wheels 134 as the operative bustling elements, by adjusting the bustle frames 33 to positions near the upper ends of the stems 28, so that the bustle wheels 134 protrude upwardly, beyond the upper ends of the air nozzles 30. Thus, as the stems 28 are adjusted upwardly, the bustle wheels 134 engage the web and form the bustles 49, 50 and 51 therein. The depth of the bustles is adjusted by adjusting the vertical positions of the stems 28. The depth of the bustles is exaggerated in FIG. 12, for clarity of illustration. The formation of the bustles has the effect of drawing in the edges of the web 5. In this way, the bustles effectively shrink or contract the width of the printed web to its original width, before the web enters the next printing unit. Thus, the width of the previously printed color image on the web is reduced to its original width, so that precise registration can be achieved between the previously printed color image and the next color image.

Figure 12A:
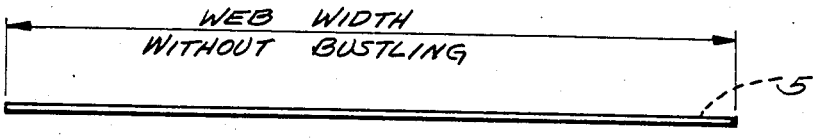
FIG. 12*a* is a cross sectional view showing the web without bustling, for comparison with FIG. 12, to illustrate the manner in which the bustling action shrinks the width of the web.
Figure 12:
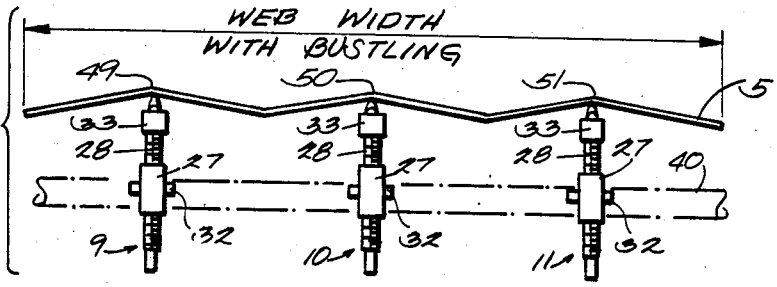
FIG. 12 is a cross sectional view, taken through the printed web and illustrating the formation of bustles in the web by three of the bustling devices, as shown in FIG. 7.

For comparison with FIG. 12, FIG. 12*a* shows the fanned out width of the web 5, after the printing of the first color image, but without bustling. It will be noted that the bustled web 5 of FIG. 12 is slightly narrower than the unbustled web of FIG. 12*a*, in that the bustled web has been drawn in or contracted to its original width.

The bustling action of the bustle wheel 134 has just been described in connection with FIG. 12. FIGS. 2–5 show the bustling device with the bustle wheel 134 adjusted to its bustling or operative position, in which the wheel frame 33 is adjusted toward the upper end of the stem 28, so that the wheel 134 protrudes above the air nozzle 30. Such adjustment is achieved by loosening the set screw 45, out of clamping engagement with the stem 28, moving the wheel frame 33 upwardly toward the upper end of the stem 28, as shown in FIGS. 2–9, and tightening the set screw 45 into clamping engagement with the stem 28. The set screw 45 is engageable with the set screw receiving groove 44*a* in the stem 28, as shown in FIG. 10.

When the operator desires to select air bustling, the bustle wheel 134 is withdrawn or retracted so that it does not project above the air nozzle 30. The bustling device is shown in its air bustling position in FIGS. 6–9. The bustle wheel 134 is retracted by loosening the set screw 45, out of clamping engagement with the stem 28, moving the wheel frame 33 downwardly along the stem, so that the wheel 134 is below the level of the air nozzle 30, and retightening the set screw 45. In FIGS. 6–9, the wheel frame 33 has also been turned through 180°, relative to its position in FIGS. 2–5, so that the wheel 134 overlies the supporting body 27. However, the wheel frame 33 may simply be moved downwardly from its raised position, as shown in FIGS. 2–5, so that the wheel 134 will not be engageable with the web 5. The set screw 45 may then be clamped into engagement with the groove 44*a* in the stem 28.

For both air and wheel bustling, the stem 28 is advanced toward the web 5 in a direction generally perpendicular to the web. The stem 28 is adjusted by loosening the set screw 43, out of clamping engagement with the set screw groove 44*a* in the stem 28, turning the adjusting knob 32 so that the internally threaded knob 32 causes longitudinal movement of the externally threaded stem 28, and retightening the set screw 43 into clamping engagement with the set screw groove 44*a*, so that the stem 28 is clamped to the body 27. When the adjusting knob 32 is to be rotated, the set screw 43 is preferably loosened only enough to unclamp the stem 28, while leaving the set screw 43 with its tip loosely received in the groove 44*a*, so as to prevent rotation of the stem 28, when the knob 32 is rotated.

To adjust the transverse position of the bustling device, the set screw 41 is loosened so that the supporting body 27 can be slid laterally along the supporting bar or rod 40. The set screw 41 is then retightened. The transverse position of the bustling device determines the transverse location of the bustle which is produced in the web 5 by the bustling device.

For air bustling, compressed air is supplied to the bustling device. For wheel bustling, the compressed air is turned off. A combination of air bustling and wheel bustling can be employed, by adjusting some of the bustling devices for wheel bustling, and others for air bustling. In that case, compressed air is supplied to only the bustling devices which are employed for air bustling.

The compressed air supply system is shown in FIG. 1. When any particular bustling device is to be employed for air bustling, the compressed air source 12 is activated, and the master ON-OFF valve 13 is turned on. Assuming that the bustling device 21 has been selected for air bustling, the ON-OFF valve 15 for the bustling system 8 is turned on. In addition, the ON-OFF valve 18 for the bustling device 21 is turned on. The bustle wheel 134 for the bustling device 21 is retracted below the level of the air nozzle 30, in the manner previously described. The stem 28 is advanced upwardly so that the nozzle 30 is close to the web 5, without actually contacting the web. The pressure of the compressed air to the air nozzle 30 is adjusted by operating the fully adjustable flow regulating valve 24, to vary the strength of the air jet discharged from the air nozzle 30. The air jet, directed against the web, produces a longitudinal bustle or ridge in the web. The depth of the bustle can be varied by adjusting the position of the stem 28, to raise and lower the air nozzle 30, and also by adjusting the valve 24, to increase or decrease the pressure of the compressed air supplied to the nozzle 30.

In the apparatus of FIG. 1, the height of each air nozzle 30 is individually adjustable, by turning the corresponding knob 32 to adjust the corresponding stem 28 vertically, as previously described. Each nozzle 30 has its own fully adjustable flow regulating valve, so that the depth of each bustle can be precisely adjusted.

Each bustling device of FIG. 1 has its own ON-OFF air valve, which can be shut off, when wheel bustling is desired. The corresponding wheel 134 is adjusted to its bustling position, as previously described.

If only air bustling is desired, the wheel frames 33 can be removed entirely from the adjustable stems 28.

In each bustling device, the bustling wheel is made of metal, such as steel, or a suitable resinous plastic material, such as nylon, for example. Generally, the body 27, stem 28, nozzle 30, knob 32 and frame 33 are made of metal, although sturdy resinous plastic materials can be employed, in some instances.

Instead of using the simple set screw 43 as the retainer for the adjustable stem or carriage 28, some other retaining device may be employed, such as a known or suitable frictional retaining device. For example, the set screw 43 may be replaced by a spring plunger device having a steel or other suitable ball, pressed into the groove 44*a* and against the stem 28 by a compression coil spring, which is compressed by a screw, threaded into the opening 44. The spring-loaded ball affords frictional resistance to the adjusting movement of the stem 28, so that the adjustment of the stem will not be disturbed accidentally or by vibration. The spring-pressed ball also prevents rotation of the stem 28.

Various other modifications, alternative constructions and equivalents may be employed, within the true spirit and scope of the appended claims.

I claim:

1. A combination wheel-air bustling device for producing an adjustable bustle in a printing web as it travels between successive printing units of a multicolor printing press, such device comprising supporting means having mounting means for mounting such supporting means in a selected location between the successive printing units and opposite the printing web, carriage means movably mounted on such supporting means for movement in a direction generally perpendicular to the printing web, air nozzle means mounted on such carriage means to direct an air jet against the web for producing a bustle therein, bustle wheel means mounted on such carriage means to engage and deflect the web for producing a bustle therein, selecting means to produce relative movement between the bustle wheel means and the air nozzle means for selectively bringing either the air nozzle means or the bustle wheel means into its operative bustle-forming relationship with the printing web to form a bustle therein, and adjusting means for producing adjusting movement of the carriage means and the selected air nozzle means or bustle wheel means in a direction generally perpendicular to the printing web for adjusting the depth of the bustle formed therein by the selected air nozzle means or bustle wheel means.

2. A device according to claim 1, such supporting means including a supporting body having a guide opening therein, such carriage means including a hollow tubular stem movably received in such guide opening for movement in a direction generally perpendicular to the printing web, such stem having a longitudinal air supply opening extending therein;

said air nozzle means including an air nozzle connected to one end of such air supply opening for movement with such stem toward and away from the web, such stem having means connected to the other end of the air supply opening for supplying compressed air thereto, such adjusting means comprising an adjusting mechanism connected between the body and the stem for producing adjusting movement of the stem through the guide opening therein.

3. A device according to claim 2, in which such adjusting mechanism comprises a rotatable adjusting knob rotatably retained on such supporting body, such knob having a bore therein aligned with such guide opening and formed with internal screw threads, such stem extending through such bore and having external screw threads mating with such internal screw threads whereby rotation of such knob causes adjusting movement of the stem through the guide opening.

4. A device according to claim 3, in which such supporting body includes a pair of fork portions with a slot therebetween for rotatably receiving and retaining such adjusting knob.

5. A device according to claim 3, including retaining means for retaining the adjustment of the stem relative to the supporting body.

6. A device according to claim 2, such bustle wheel means comprising a bustle wheel frame mounted on such stem, and a bustle wheel rotatably mounted on such frame, such selecting means comprising a portion of such bustle wheel frame formed with a stem opening in which such stem is movably received to provide for adjusting movement of such frame along the stem relative to the air nozzle whereby the bustle wheel is movable into and out of operative engagement with the printing web, and adjustment retaining means for retaining the adjustment of the wheel frame along the stem.

7. A device according to claim 6, such adjustment retaining means comprising a frame-clamping screw for selectively clamping the frame to the stem.

8. A device according to claim 2, such mounting means comprising a transverse supporting bar extending transversely to the direction of the stem, the supporting body having a transverse opening for movably receiving such transverse supporting bar, and body clamping means for selectively clamping the body to the transverse supporting bar.

9. A device according to claim 1, further including a compressed air supply system connected to such air nozzle means and including a fully adjustable air regulating valve for adjusting the pressure of the compressed air supplied to the air nozzle means and thereby adjusting the strength of the air jet and the depth of the bustle.

10. A device according to claim 9, in which such compressed air supply system also includes an ON-OFF air valve connected in series with the regulating valve for turning on and shutting off the supply of compressed air to the nozzle means.

11. An apparatus comprising a device as defined in claim 1, and at least one additional device of the same construction as defined in claim 1, such devices being mounted in a laterally spaced arrangement adapted to be positioned between the printing units and opposite transversely spaced portions of the printing web to form a plurality of transversely spaced bustles therein.

12. An apparatus according to claim 11, comprising a compressed air supply system connected to all of the air nozzle means of the devices, such system comprising a plurality of fully adjustable air regulating valves connected to the individual air nozzle means for regulating the pressure of the compressed air supply to the individual air nozzle means and thereby adjusting the strength of the air jets and the depth of the bustles formed by the individual air nozzle means.

13. An apparatus according to claim 12, in which such compressed air supply system includes a plurality of ON-OFF air valves connected in series with the individual air regulating valves.

14. An apparatus comprising a device as defined in claim 1 and a plurality of additional devices of the same constructicn as defined in claim 1, all of such devices being arranged in a plurality of groups adapted to be mounted between successive printing units of a multicolor printing press, each group comprising a plurality of such devices arranged in a transversely spaced arrangement opposite transversely spaced portions of the printing web to form a plurality of transversely spaced bustles therein.

15. An apparatus according to claim 14, including a compressed air supply system for supplying compressed air to all of the air nozzle means of all of such devices, such system comprising a plurality of fully adjustable air regulating valves connected to the individual air nozzle means for individually adjusting the pressure of the compressed air supplied thereto and thereby adjusting the strength of the jets and the depth of the bustles formed by the individual air hozzle means.

16. An apparatus according to claim 15, in which such compressed air supply system comprises a plurality of ON-OFF air valves connected in series with the individual regulating valves to shut off and turn on the supply of compressed air to the individual air nozzle means.

17. An apparatus according to claim 16, which such compressed air supply system includes a master ON-OFF air valve for shutting off and turning on the supply of compressed air to at least a group of such air nozzle means.

18. A combination wheel-air bustling device for producing an adjustable bustle in a printing web as it travels between successive printing units of a multicolor printing press, such device comprising a supporting body having adjustable mounting means for mounting such body in a selected location between the successive printing units and opposite the printing web, such body having a guide opening extending in a direction generally perpendicular to the printing web, a carriage comprising a hollow tubular stem movably received in such guide opening for adjusting movement toward and away from the printing web, such stem having a longitudinal air supply opening therein, an air nozzle mounted on one end of the stem and connected to the corresponding end of the air supply opening for selectively directing an air jet against the web to form a longitudinal bustle therein, the stem having means for supplying compressed air to the other end of the air supply opening, a rotatable adjusting knob rotatably retained on such body and having a bore aligned with such guide opening and formed with internal screw threads, such stem having external screw threads mating with such internal screw threads whereby rotation of such knob causes adjusting movement of such stem through such guide opening in a direction generally perpendicular to the web to adjust the depth of the bustle, a bustle wheel frame, a bustle wheel rotatably mounted on such frame, such frame having a stem opening therein for movably receiving the stem whereby the frame is selectively adjustable along the stem for selecting between wheel bustling and air bustling positions, the wheel protruding beyond the air nozzle in the wheel bustling position whereby the wheel is engageable with the printing web to form a bustle therein, the wheel being withdrawn away from the web in the air bustling position whereby the wheel is inoperative to form a bustle and the air nozzle is operative to direct an air jet against the web to form a bustle therein, and retaining means for retaining the adjustment of the bustle wheel frame along the stem, the knob being operable to move the stem and thereby to adjust the depth of the bustle in both the wheel bustling position and the air bustling position.

19. A device according to claim 18, such mounting means comprising a transverse supporting bar extending transversely to the direction of the guide opening, the body having a transverse opening for receiving the supporting bar whereby the body is movable along the bar, and clamping means for clamping the body to the bar.

20. A combination wheel-air bustling device for producing an adjustable bustle in a printing web as it travels between successive printing units of a multicolor printing press, such device comprising a supporting body having adjustable mounting means for mounting such body in a selected location between the successive printing units and opposite the printing web, such mounting means comprising a transverse supporting bar extending generally parallel with the web, the body having a transverse opening for receiving the supporting bar whereby the body is movable along the bar, clamping means for clamping the body to the bar, such body having a guide opening extending in a direction generally perpendicular to the printing web, a carriage comprising a hollow tubular stem movably received in such guide opening for adjusting movement toward and away from the printing web, such stem having a longitudinal air supply opening therein, an air nozzle mounted on one end of the stem and connected to the corresponding end of the air supply opening for selectively directing an air jet against the web to form a longitudinal bustle therein, the stem having means for supplying compressed air to the other end of the air supply opening, a rotatable adjusting knob rotatably retained on such body and having a bore aligned with such guide opening and formed with internal screw threads, such stem having external screw threads mating with such internal screw threads whereby rotation of such knob causes adjusting movement of such stem through such guide opening in a direction generally perpendicular to the web to adjust the depth of the bustle, such body having a pair of fork portions with a slot therebetween for rotatably retaining the knob, a bustle wheel frame, a bustle wheel rotatably mounted on such frame, such frame having a stem opening therein for movably receiving the stem whereby the frame is selectively adjustable along the stem for selecting between wheel bustling and air bustling positions, the wheel protruding beyond the air nozzle in the wheel bustling position whereby the wheel is engageable with the printing web to form a bustle therein, the wheel being withdrawn away from the web in the air bustling position whereby the wheel is inoperative to form a bustle and the air nozzle is operative to direct an air jet against the web to form a bustle therein, retaining means for retaining the adjustment of the bustle wheel frame along the stem, the knob being operable to move the stem and thereby to adjust the depth of the bustle in both the wheel bustling position and the air bustling position, and additional retaining means for retaining the adjustment of the stem relative to the body.

21. An air bustling device for producing an adjustable bustle in a printing web as it travels between successive printing units of a multicolor printing press, such device comprising a supporting body having adjustable mounting means for mounting such body in a selected location between the successive printing units and opposite the printing web, such mounting means comprising a transverse supporting bar extending generally parallel with the web, the body having a transverse opening for receiving the supporting bar whereby the body is movable along the bar, clamping means for clamping the body to the bar, such body having a guide opening extending in a direction generally perpendicular to the printing web, a carriage comprising a hollow tubular stem movably received in such guide opening for adjusting movement toward and away from the printing web, such stem having a longitudinal air supply opening therein, an air nozzle mounted on one end of the stem and connected to the corresponding end of the air supply opening for selectively directing an air jet against the web to form a longitudinal bustle therein, the stem having means for supplying compressed air to the other end of the air supply opening, a rotatable adjusting knob rotatably retained on such body and having a bore aligned with such guide opening and formed with internal screw threads, such stem having external screw threads mating with such internal screw threads whereby rotation of such knob causes adjusting movement of such stem through such guide opening in a direction generally perpendicular to the web to adjust the depth of the bustle, such body having a pair of fork portions with a slot therebetween for rotatably retaining the knob, and retaining means for retaining the adjustment of the stem relative to the body.

* * * * *